US005423665A

United States Patent [19]

Hentschel et al.

[11] Patent Number: 5,423,665

[45] Date of Patent: Jun. 13, 1995

[54] APPARATUS FOR PRODUCING FILAMENTS FROM MELTABLE MATERIAL

[75] Inventors: Rolf Hentschel, Walsheim; Harald Schenk; Robert Groten, both of Weinheim; Achim Gruber, Schönau, all of Germany

[73] Assignee: Firma Carl Freudenberg, Weinheim, Germany

[21] Appl. No.: 184,325

[22] Filed: Jan. 19, 1994

[30] Foreign Application Priority Data

Jan. 20, 1993 [DE] Germany ..... 43 01 373.2

[51] Int. Cl.[6] ..... B29C 47/08

[52] U.S. Cl. ..... 425/8; 264/8; 425/378.2

[58] Field of Search ..... 425/8, 6, 378.1, 382.2; 264/8

[56] References Cited

U.S. PATENT DOCUMENTS

| | | | |
|---|---|---|---|
| 3,409,712 | 11/1968 | Chisholm | 425/8 |
| 3,596,312 | 8/1971 | Ohmatsu | 425/8 |
| 3,907,537 | 9/1975 | Irgens-Bergh | 264/8 |
| 4,359,444 | 11/1982 | Shah et al. | 425/8 |
| 4,948,409 | 8/1990 | Chenoweth et al. | 425/8 |
| 5,326,241 | 7/1994 | Rook et al. | 425/8 |

FOREIGN PATENT DOCUMENTS

| | | | |
|---|---|---|---|
| 44-900 | 1/1969 | Japan | 425/8 |
| 952793 | 3/1964 | United Kingdom | 425/8 |

*Primary Examiner*—Khanh Nguyen
*Attorney, Agent, or Firm*—Kenyon & Kenyon

[57] ABSTRACT

An apparatus for producing filaments from meltable material utilizing centrifugal force includes a hollow body (2) rotating at high speed, whose bottom (5) the meltable material strikes from above in the solid state. The wall of the hollow body, shaped as a cylindrical casing, is formed by a heating device (4) which includes metal elements running in a rectangular and helical fashion, such that the interstices of the helix form the discharge openings for the molten material.

18 Claims, 2 Drawing Sheets

APPARATUS FOR PRODUCING FILAMENTS FROM MELTABLE MATERIAL

BACKGROUND OF THE INVENTION

1. Field of the Invention

The present invention relates to an apparatus for producing filaments from meltable material utilizing centrifugal force.

2. Description of Related Art

An apparatus of this kind has been disclosed by U.S. Pat. No. 3,596,312. It consists of a cylindrical hollow body open at the top, rotating at high speed about its vertical axis. It is surrounded peripherally by a wall in the form of a cylindrical casing, which has a plurality of discharge openings. Concentrically with this cylindrical wall, the rotating hollow body contains a heating device which is capable of melting, upon contact, the meltable synthetic material that is introduced into the hollow body in a solid condition. The heating device rotates at the same speed as the rest of the hollow body about its rotation axis.

The known apparatus further contains a funnel-shaped charging station through which the solid synthetic material continuously falls by gravity into the rotating hollow body, strikes its bottom, and is thrown toward the heating device by centrifugal force. From there, again because of the centrifugal force acting on it, it is delivered over a short distance to the outer cylindrical casing provided with openings, thrown out through these openings, and cooled in filament form. Rotation of the cylinder is effected by a drive device, for example an electric motor.

According to one alternative, the material to be melted is charged into the rotating cylindrical cavity in the form of pellets, flakes, or powder. Thermoplastics, such as polyamide, polyethylene, polystyrene, and polypropylene, are mentioned as suitable synthetic meltable materials.

The spherical or cylindrical heating device in the interior of the rotating hollow body is operated electrically. The hollow body is closed; i.e. its entire internal volume is used for heating.

The material leaving the rotating hollow body through the peripheral nozzle openings is, while it is immediately cooled into individual fibers, continuously pulled downward into a bell-shaped stationary suction device surrounding the rotating hollow body at a distance, and can thus be immediately coiled up as a twisted, endless fiber yarn. The length of the resulting monofilaments can be influenced by varying the temperature of the molten polymer material and the rotation speed of the hollow body.

The particular centrifugal force acting on the polymer is determined by the rotation speed and/or the internal radius of the hollow body.

The advantage of this kind of apparatus and of the method indicated lies especially in the complete utilization of the meltable fiber-forming material that is used. Drawing into fibers or filaments occurs essentially by means of centrifugal force, and can be very precisely controlled thereby.

A disadvantage of this known apparatus, however, is that the thermoplastic polymer material melted by the heating device must, in the hot, fluid state, cover a certain distance tangential to the rotation direction of the hollow body in order to reach the discharge openings of the rotating outer cylindrical casing which are arranged concentrically with the heating system. The time period in which this distance can be covered is not less than three seconds. The result of this is that with thermoplastic polymers which decompose easily—e.g. in cases where the decomposition temperature is just above the softening temperature—pyrolysis will begin during this period of time, and for that reason, and because the nozzles become clogged with pyrolyzed material, fiber formation is disrupted or made entirely impossible.

Examples of such problematic thermoplastic fiber-forming materials are polyesters and polyamides that are not predried and still contain more than 50 ppm water, for example polybutylene terephthalate, polyethylene terephthalate, and polyepsilon caprolactone, as well as the easily pyrolyzed thermoplastic materials ethylene vinyl acetate, polyurethane, polyester polyurethane, the polylactides, and polyhydroxybutyrate/-polyhydroxyvalerate copolymers, as well as native sugar, for example sucrose.

SUMMARY OF THE INVENTION

Accordingly, it is an object of the present invention to develop an apparatus of the aforesaid type which can also be used to spin polymer materials that are not carefully predried or that pyrolyze at close to the softening point into filaments with which continuous nonwoven fabrics can be formed.

This object is achieved with an apparatus for producing filaments from meltable material utilizing centrifugal force which includes a rotatable hollow member having an open top which can be driven for rotation about its axis by a motor. The rotating hollow body has a flat, horizontally arranged bottom surface. In accordance with the invention, the heating device of the apparatus for melting the material to be spun into filaments is identical to a peripheral wall (e.g., a cylindrical casing) of the rotating hollow body.

The heating device is a closed, inductively heated cylindrical casing 1 to 3 mm thick which consists of a plurality of metal strips lying next to one another which define a spiral or helical shape. The spacings between the metal strips are 0.1 to 0.5 mm and at the same time define the discharge openings for the molten material. Each individual turn of the helix is formed by a rectangular structure so that the cross section of the heating device in the form of a cylindrical casing represents a vertically upright parallelogram.

The following Figures are intended to illustrate the invention by way of example without restricting the scope of the invention as set forth in the claims.

DETAILED DESCRIPTION OF THE INVENTION

Figure 1:
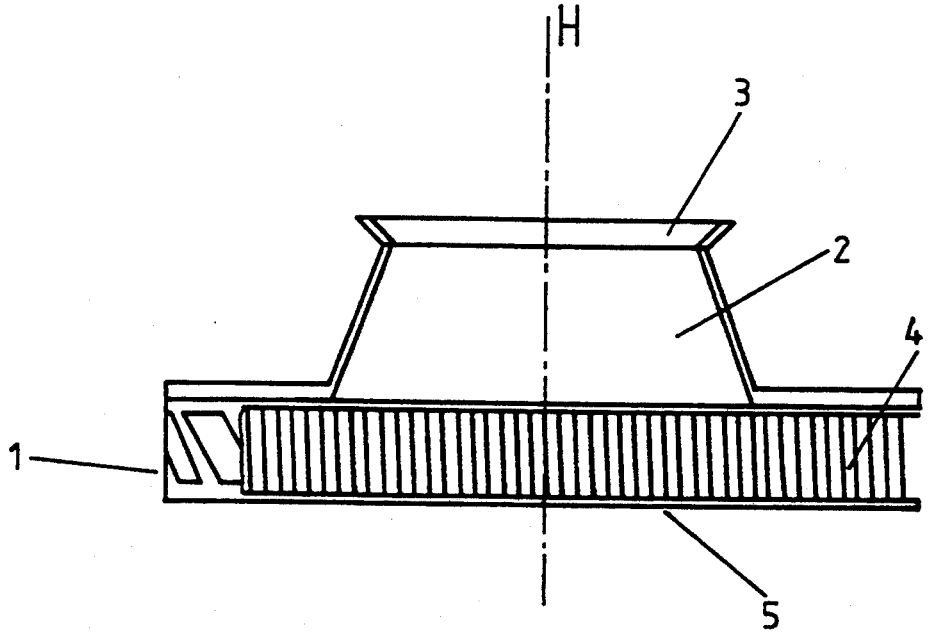
FIG. 1 shows a schematic perspective depiction of an apparatus of the invention which exposes the heating helix to view.

Referring to FIG. 1, an apparatus for producing filaments in accordance with the invention is illustrated. The apparatus includes a cylindrical hollow body (2) open at the top, rotating at high speed about the vertical axis (H), with a plurality of discharge openings present in its peripheral wall (1). A heating device (4) is located inside the rotating hollow body (2), arranged in annular fashion concentrically with its rotation axis, for heating the meltable material charged into the rotating hollow body (2) in the solid state above its softening range. A funnel-shaped charging station (3) for the solid meltable material opens directly into the interior of the rotating hollow body and continuously delivers the solid material by gravity onto the bottom (5) of the rotating cylindrical hollow body. A drive device is provided for the rotating hollow body, such that the material heated in the hollow body is thrown out by centrifugal force through the discharge openings present in the circumferential direction of the hollow body, and cooled into filaments.

In FIG. 1, the heating helix 4 is exposed to view. The boundary of the heating helix 4 is peripheral wall 1. Cavity 2 (which is open at the top) and charging funnel 3 are fixed, while peripheral wall 1, heating helix 4 and bottom plate 5 can rotate about the vertical axis H of the apparatus. Boundary 1 of the heating helix simultaneously forms the nozzle openings of the spinning rotor through which the molten material is thrown tangentially outward.

Figure 2:
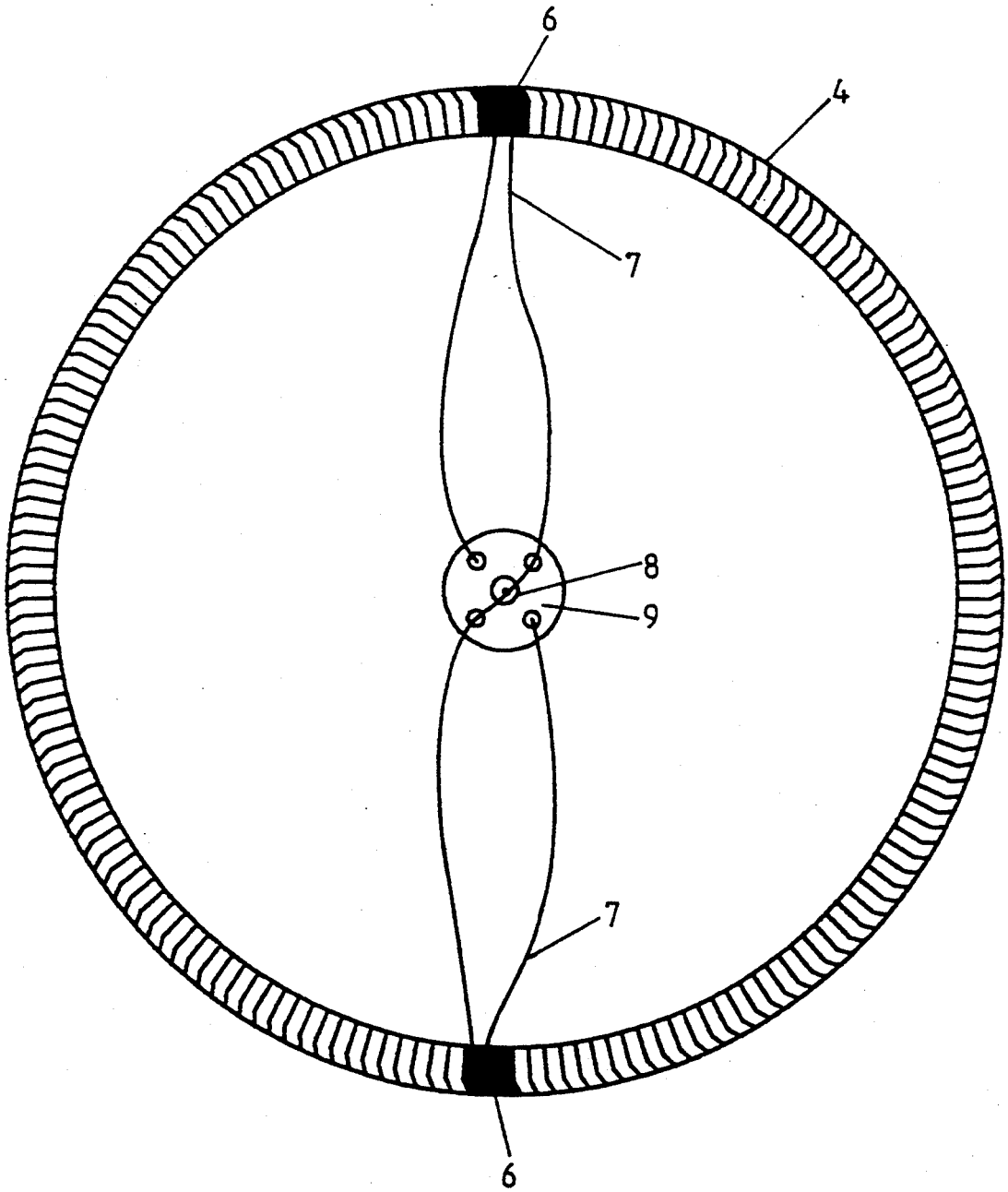
FIG. 2 shows a plan view of the heating device, seen from the rotation axis of the rotating hollow body.

The top view of heating helix 4 in FIG. 2 shows the heat-resistant insulator 6 which is made, for example, of glass or porcelain, and simultaneously serves as the helix holder.

A rotary motion is imparted to helix 4; advantageously its suspension, a vertical axis 8, acts as the axis of an electric motor that is driven via a heat-resistant insulated power lead 7. The apparatus preferably includes an insulator plate 9 that has power connection contacts and wiper contacts (not visible).

The bottom surface 5 of the hollow body 2, which rotates rapidly about its vertical axis, is flat, and the heating device directly constitutes the peripheral wall 1, in the shape of a cylindrical casing, of the hollow body.

This heating device 4 consists of a plurality of inductively heated spiral turns (e.g., helixes) lying next to one another, which are made of metal strips and form, in a continuous sequence arranged next to one another, a closed cylindrical casing 1 to 3 mm thick. The individual turns and thus the cross section of the cylindrical casing are not round, but rather are flattened in a rectangular manner, so that the respective adjacent helical elements have the form of an upright. parallelogram. The spacings of the respective helical elements running parallel to the vertical axis of the rotating cylinder are 0.1 to 1.5 mm, and form the discharge openings for the material that strikes the inside of the heating device, melts there, and in that state is thrown outward.

The feature wherein the heating device 4 is identical to the cylindrical casing 1 of the hollow body 2 and at the same time forms the discharge openings for the molten material also means an extremely short time, i.e. from less than one to three seconds, during which the particular material is exposed to melting contact with the heating device. As a result, even when the softening and decomposition temperatures are close together, pyrolysis or any other kind of decomposition cannot occur even if the thermoplastic is briefly heated far above its actual decomposition temperature when in contact with the heating system.

Thus in the apparatus according to the invention the upper limit of the temperature of the heating device is not critical, provided its thickness, i.e. the distance to be traveled through each discharge opening of 3 mm is not exceeded.

The parameters influencing the quality of the spun filaments, such as rotation speed, inside diameter of the rotating cylindrical casing or heating device, and geometry and cross section of the discharge openings, are known from the prior art in terms of their effect, so that in preliminary tests these variables can be adjusted by varying the conditions and desired results based on the existing knowledge of persons skilled in the art; thus no new procedural instructions need be provided for the apparatus according to the invention.

The electrical energy required for inductive heating of the rotating cylinder wall is advantageously less than 1 kWh per kg of polymer compound used, i.e. of meltable material. This energy consumption is surprisingly low; comparable spinning methods with stationary nozzles require 3 to 9 kWh/kg.

All meltable polymers whose decomposition temperature is above the softening temperature, and which form filaments when stretched, can be spun with the apparatus according to the invention.

In contrast to the prior art, the ability to generate filaments is unaffected by whether or not the maximum temperature of the meltable polymer material in the spinning process lies above its glass transition temperature or above its softening temperature. These factors influence only the titer and the degree or stretching or crystallinity of the spun filaments.

With the apparatus, it is readily possible to increase the heat energy acting on the meltable polymer material so that the viscosity is reduced to such a degree that on the one hand, the greatest possible diminution of the polymer melts leaving the apparatus—and thus the greatest possible stretching thereof—is achieved, while on the other hand the material does not crystallize completely but becomes capable of being sealed, so as to form an isotropic network with the other filaments when the nonwoven fabric is laid down.

The heat energy can be raised empirically while the rotor according to the invention is operating so that filaments with a thickness of only a few micrometers can be laid down as nonwoven fabric, such that mutual filament adhesion is guaranteed. It must be emphasized once again that this effect can be achieved only with the apparatus according to the invention, since only with it does the molten material not have to cover any appreciable distance between the time it is heated and the time it leaves the nozzles.

The meltable polymer material being spun can be continuously delivered from above into the rotating cylindrical hollow body in any form, for example as fibers or pellets, or in powder or flake form. Advantageously, the particle size corresponds at least to the spacing between the individual helical turns. Larger particles can be used, up to dimensions that might damage the heating device due to excessive momentum. However, material sizes of 2 to 7 mm can be processed without difficulty.

A further possible rule of thumb is that with a hollow body diameter of, for example, 20 cm, a throughput of solid material for spinning of up to 12 kg/h is possible. The filaments leaving the spinning openings or heating system and forming in the surrounding area are preferably collected by means of a cylindrical screen that is arranged concentrically with the rotor axis at a distance of 1 to 20 cm.

It is also possible to configure the collector screen as a strip passing peripherally around the rotor, which is coated with the filaments after passing around once, and can be sent on for further processing.

EXAMPLE 1

The apparatus according to the invention was operated to produce filaments from a meltable material. Operating parameters were:

| | |
|---|---|
| Heating helix rotation frequency | 2950 rpm |
| Heating helix temperatuer | 100° C. |
| Heating helix diameter | 20 cm |
| Heating helix height | 2 cm |

The molten material supplied to the apparatus was a polyurethane with a melting range around 150° C., produced from hexamethylene diisocyanate and Desmophen 2001 (Bayer, Leverkusen), a polyester polyol.

| | |
|---|---|
| Pellet particle size | 2–4 mm |
| Predrying | none |
| Throughput | 1.25 g polymer per second |

The resulting polyurethane filaments were collected on a solid polyethylene screen in the shape of a cylindrical casing, which surrounds the heating wall concentrically at a distance of 7 cm, and which were laid down into an autogenous fiber-composite nonwoven fabric. Within a few seconds, this fabric attained sufficient strength and elasticity such that it could be lifted away from the screen without damage. In this way it was possible to produce nonwoven fabrics with a thickness of as little as 0.4 mm, which for further reinforcement can be subjected, for example, to stamping calendaring under heat and pressure.

The filaments forming the nonwoven fabric had diameters of approximately 8μ.

EXAMPLE 2

The process described in Example 1 was utilized, except that now the helix temperature was 250° C. The filaments that emerge were only approximately 3μ thick and formed a flat structure similar to a nonwoven fabric that, because the filaments are so fine, was almost like a film but was also porous.

EXAMPLE 3

Using an apparatus of the kind cited in Example 1, polyamide-6 with a melting range around 220° C. was processed into filaments without prior drying at a helix temperature of 155° C., and a second time at 250° C. The particle sizes of the polyamide used were between 2 and 3 mm.

At 155° C. fiber agglomerates were produced on the screen as a loose structure; the result at 250° C. was an autogenously welded flat structure of fine (diameter 3μ) to coarse (diameter 10μ and more) filaments. In both cases, crystallization occurs immediately after emergence from the nozzles.

EXAMPLE 4

Undried poly-1-lactide with a melting range around 180° C. was spun at a helix temperature of first 165° C. and then 250° C. The particle sizes used were 2 to 5 mm.

The lactide crystallized immediately after emerging from the nozzle. At 165° C. the result was a very coarse nonwoven fabric that may still contain particles, while at 250° C. nonwoven fabrics with a fine to medium structure were produced., with filament diameters of 3 to 6μ.

EXAMPLE 5

Undried ethylene vinyl acetate with a melting range of 35° to 100° C., which until now was regarded as unspinnable because of its tendency toward immediate pyrolysis, was spun in an apparatus according to Example 1 at a heating helix temperature first of 110° C., then a second time at 165° C. The particle size used was 3 to 5 mm.

Spinning temperatures of 110° C. lead to pellets with incipient melting at the surface, and to the formation of agglomerates on the collector screen. A heating helix temperature of 165° C. produced a nonwoven fabric with elastic characteristics, autogenously bonded by means of its fibers, which has a very homogeneous filament distribution.

EXAMPLE 6

Undried polyhydroxyvalerate/polyhydroxybutyrate copolymer, which is obtained from bacteria and has a melting range around 186° C., was fed into the charging opening in particle sizes of 2 to 7 mm, under the same operating parameters as in Example 1. The heating helix temperature was first 137° C., and then 250° C.

Two variants were spinnable: one with 5 wt % polyhydroxyvalerate, and another with 24 wt %. A crystallization accelerator did not need to be added.

The formulation with 5 wt % polyhydroxyvalerate yielded, at 137° C., an immediately unmoldable, coarse, brittle nonwoven fabric with little strength. At 250° C. a considerably finer fabric structure was observed.

The variant with 24 wt % polyhydroxyvalerate yielded a coarse fabric structure at a spinning temperature of 137° C. When the material was spun at a heating helix temperature of 250° C., the melt leaving the spinning rotor deliquesced on the surface of the deposition screen and formed a film-like skin that was sufficiently strong to be removed from the surface without damage.

In all the Examples, the surface temperature of the heating helix was determined pyrometrically.

EXAMPLE 7

(Comparison with the Prior Art)

The meltable materials of Examples 1 to 4 and 6 were placed in conventional spinning rotors corresponding to U.S. Pat. No. 3,596,312. The distances traveled by the polymer compound between the heating device and the nozzle openings were not short enough to prevent the materials from refreezing; after a short time the nozzles were clogged, or no filaments were produced, as for example with poly-1-lactide.

Pyrolysis of the material being spun was often observed, accompanied by smoking; tar-like residues frequently formed in the process.

Polyamide-6 cannot be spun into filaments at 250° C. without prior drying.

What is claimed is:

1. An apparatus for producing filaments from a meltable material utilizing centrifugal force, comprising: a hollow member having a horizontally disposed bottom surface and an opening at a top thereof, the hollow member being rotatable about a vertical axis thereof, the hollow member including an integrally formed peripheral heating wall which defines a plurality of discharge openings therein, the heating wall being a closed, inductively heated cylindrical casing comprised of a plurality of metal strips which are adjacent to each other and which collectively define a helix, and the heating wall being capable of melting the meltable material; and a means for rotating the hollow member about its vertical axis at a speed which is sufficient to force material melted by the peripheral heating wall out of the discharge openings under the action of centrifugal force to result in filaments.

2. The apparatus according to claim 1 wherein the cylindrical casing has a thickness of from 1 mm to 3 mm.

3. The apparatus according to claim 1 wherein the discharge openings are defined by spaces between said adjacent metal strips, the spaces having a width of from 0.1 mm to 0.5 mm.

4. The apparatus according to claim 2 wherein the discharge openings are defined by spaces between said adjacent metal strips, the spaces having a width of from 0.1 mm to 0.5 mm.

5. The apparatus according to claim 1 wherein the heating wall defines a plurality of helical turns, each turn defining a rectangular structure so that a cross-section of the heating wall defines a vertically upright parallelogram.

6. The apparatus according to claim 2 wherein the heating wall defines a plurality of helical turns, each turn defining a rectangular structure so that a cross-section of the heating wall defines a vertically upright parallelogram.

7. The apparatus according to claim 1 further comprising a funnel-shaped charging station which opens into the top of the hollow member and which can continuously deliver meltable material by gravity onto the bottom surface of the hollow member.

8. The apparatus according to claim 1 wherein the heating wall is cylindrical and is arranged concentrically with said vertical axis of the hollow member.

9. The apparatus according to claim 3 wherein the heating wall defines a plurality of helical turns, each turn defining a rectangular structure so that a cross-section of the heating wall defines a vertically upright parallelogram.

10. The apparatus according to claim 4 wherein the heating wall defines a plurality of helical turns, each turn defining a rectangular structure so that a cross-section of the heating wall defines a vertically upright parallelogram.

11. The apparatus according to claim 2 further comprising a funnel-shaped charging station which opens into the top of the hollow member and which can continuously deliver meltable material by gravity onto the bottom surface of the hollow member.

12. The apparatus according to claim 3 further comprising a funnel-shaped charging station which opens into the top of the hollow member and which can continuously deliver meltable material by gravity onto the bottom surface of the hollow member.

13. The apparatus according to claim 5 further comprising a funnel-shaped charging station which opens into the top of the hollow member and which can continuously deliver meltable material by gravity onto the bottom surface of the hollow member.

14. The apparatus according to claim 2 wherein the heating wall is arranged concentrically with said vertical axis of the hollow member.

15. The apparatus according to claim 3 wherein the heating wall is arranged concentrically with said vertical axis of the hollow member.

16. The apparatus according to claim 5 wherein the heating wall is arranged concentrically with said vertical axis of the hollow member.

17. The apparatus according to claim 7 wherein the heating wall is arranged concentrically with said vertical axis of the hollow member.

18. In an apparatus for producing filaments from a meltable material utilizing centrifugal force which includes: a cylindrical hollow body open at a top thereof, which is rotatable at a high speed about a vertical axis thereof and which defines a plurality of discharge openings in a peripheral wall thereof; a heating element located inside the hollow body, arranged in annular fashion concentrically with said vertical axis, for heating meltable material which is charged into the hollow body in a solid state above its softening point; a charging station for the solid meltable material, which opens directly into an interior of the hollow body and for continuously delivering the solid material by gravity onto a bottom of the hollow body; and a motor for rotating the hollow body, such that the material heated in the hollow body is thrown out by centrifugal force through the discharge openings present in the circumferential direction of the hollow body, and cooled into filaments; the improvement comprising:

a heating element which is identical to the peripheral wall of the hollow body, wherein the heating element is a closed, inductively heated cylindrical casing having a thickness of from 1 to 3 mm which includes a plurality of metal strips collectively defining a helix, wherein the discharge openings are defined by spacings between adjacent metal strips which are 0.1 to 0.5 mm in size, such that each individual turn of the helix defines a rectangular structure so that the cross section of the heating device represents a vertically upright parallelogram.

* * * * *